US006062422A

United States Patent [19]

Ellis

[11] Patent Number: 6,062,422

[45] Date of Patent: May 16, 2000

[54] PAPER ROLL DISPENSER

[76] Inventor: Richard S. Ellis, 30 Bondgate Ct., Scarborough, Ontario M1B 3A1, Canada

[21] Appl. No.: 09/052,132

[22] Filed: Mar. 31, 1998

[51] Int. Cl.[7] ..... A47K 10/24

[52] U.S. Cl. ..... 221/45; 242/560.2

[58] Field of Search ..... 221/33, 45, 282, 221/283; 242/560, 560.2, 560.3, 597.5, 597.7

[56] References Cited

U.S. PATENT DOCUMENTS 2,991,951 7/1961 Carroll ..... 242/560.2

3,295,777 1/1967 Carroll ..... 242/560.2

*Primary Examiner*—Kenneth W. Noland

*Attorney, Agent, or Firm*—Ridout & Maybee

[57] ABSTRACT

A paper roll dispenser comprising an upright elongate tubular member having an upper inlet port, a lower discharge port, and a tubular passageway coupled to and extending between the inlet port and the discharge port; and an elongate member provided in the tubular passageway. An actuator is coupled to the elongate member for pivoting the elongate member about an axis transverse to the longitudinal axis of the tubular member, between a first position wherein the elongate member obstructs the tubular passageway and a second position wherein the elongate member does not obstruct the tubular passageway.

9 Claims, 2 Drawing Sheets

PAPER ROLL DISPENSER

FIELD OF THE INVENTION

This invention relates to a paper roll dispenser, and more particularly to an apparatus for the household storage and dispensation of rolls of toilet paper.

BACKGROUND OF THE INVENTION

Paper rolls, such as toilet paper rolls and paper towel rolls, are usually purchased in packages containing multiple rolls. In order to maximize the counter top space available in the household, most often these rolls are stored out of sight in storage closets. However, this practice is problematic, particularly in the case of toilet paper rolls, because a fresh toilet paper roll may not be readily available to the individual faced with the unfortunate occurrence of an empty paper roll.

Numerous attempts have been made at providing paper roll dispensers which store the paper rolls in a container for dispensation as needed. Most often, the rolls are retained in an upright container having a stop means, and are dispensed through an opening at the bottom of the container. For example, U.S. Pat. No. 3,580,651 to Gauper teaches a toilet tissue holding and dispensing apparatus comprising an elongated hollow housing 10 including a body portion 11 having a rear surface adapted to be secured to a wall. The body portion 11 has a generally rectangularly-shaped cross-section, and generally semi-circular lower sides provided with a plurality of horizontally-oriented rollers 15. A stop means 25 is provided comprising a generally arcuate-shaped member 31 whose ends extend through a longitudinally-extending slot 26 formed in the front wall of the body portion 11. The arcuate member 31 is coupled to a generally horizontally-extending arm 28, and is biased for movement about the longitudinal axis of the arm 28 through a torsion spring 30.

In operation, paper rolls 14 are inserted into the housing 10 through an opening 13 provided in the upper portion thereof, with the longitudinal axis of the rolls 14 horizontally oriented. Downward vertical movement of the lowermost roll 14 is prevented by the lower end of the arcuate member 31 engaging the lowermost roll 14. The arm 28 is then pivoted so that the lower end of the arcuate member 31 is disengaged from the lowermost roll 14. The lowermost roll 14 then drops onto the rollers 15, the tissue wound around the lowermost roll 14 being accessible through an opening 40 in the housing 10. Simultaneously, the upper end of the arcuate member 31 engages the next roll 14, thereby preventing downward vertical movement of the next roll 14. The arm 28 is then allowed to pivot back to the normal position by action of a torsion spring 30, whereupon the upper end of the arcuate member 31 becomes disengaged from the next roll 14. The next roll 14 then falls downwardly into engagement with the lower end of the arcuate member 31. However, as the rolls 14 fall a distance before being stopped by the ends of the arcuate member 31, the tissue wound around the roll 14 can be damaged by the ends of the arcuate member 31.

Wormly, in U.S. Pat. No. 4,322,042, teaches a toilet paper container and dispenser 10 in which the paper rolls are retained in an upright container with the longitudinal axes of the rolls being vertically oriented, rather than horizontally oriented as in Gauper. The dispenser 10 includes an upright enclosure 12 having a generally rectangular horizontal cross-section, a generally vertical back wall 15 adapted for securement to a supporting surface, a generally vertical front wall 30, and generally vertical side walls 31 coupled to the front wall 30 through front corners 32, 33 of increasing chamfer in the downward direction. An elongate roll guide 60 is disposed centrally within the enclosure 12, and includes a generally upright portion 61, a generally upright dispensing portion 62 extending downwardly therefrom, a lateral extension 76 extending between the lower end of the dispensing portion 62 and the supporting wall, and a pair of oblique spring fingers 65, 66 provided on opposite sides of the roll guide 60, adjacent the lower end of the enclosure 12. The upper end of the roll guide 60 is secured to a lid 45 which encloses the upper end of the enclosure 12. The roll guide 60 is bent obliquely forwardly at the lower end of the enclosure 12 such that the upright portion 61 is located closer to the supporting surface than is the dispensing portion 62.

In operation, paper rolls are inserted into the enclosure 12 with the roll guide 60 passing through the tubular core of the paper rolls. Since the upright portion 61 is located closer to the supporting surface than is the dispensing portion 62, the paper rolls stored in the enclosure 12 become oblately compressed, thereby preventing downward movement of the rolls. Downward movement is also resisted by the spring fingers 65, 66. The lowermost roll is positioned on the dispensing portion 62, supported by the lateral extension 76, thereby allowing the lowermost roll to rotate freely while dispensing paper sheets. When the lowermost roll is exhausted, the roll is torn from the roll guide 60, and the next lower roll pulled downwardly past the spring fingers 65, 66 into the dispensing position.

Numerous disadvantages are apparent with the Wormly dispenser. First, as downward movement of the stored rolls is resisted by the spring fingers 65, 66, the rolls may become damaged when pulled into the dispensing position. Second, if the rolls are oblately compressed for prolonged periods of time, the rolls may never fully return to their cylindrical shape when pulled into the dispensing position. Third, the ease with which the enclosure 12 may be refilled with paper rolls is limited by the need to secure the upper end of the roll guide 60 to the lid 45.

Francis, in U.S. Pat. No. 4,684,075 teaches a toilet paper dispenser which eliminates the need for a centrally positioned roll guide. The dispenser comprises a vertical-oriented open-ended cylindrical tube 20 mounted on the back wall 3 of a cabinet, with the bottom end of the tube 20 located at distance above the bottom wall 6 of the cabinet greater than the height of a roll of paper. The tube 20 is provided with a horizontal slot 24 disposed near the bottom of the tube 20 at a height that intersects the roll of paper immediately above the lowest roll in the tube. A spigot 23 projects upwardly from the bottom wall 6, and is centred in relation to the open end of the tube 20. A horizontal lever 35 is pivotally coupled to the cabinet to marginally clear the bottom end of the tube 20, and is biased towards the back wall 3 through a spring 38. A horizontal lever 25 is also pivotally coupled to the cabinet, and includes a vertical arm 28 for engaging the lever 35. A horizontal lever 45 is pivotally coupled to the cabinet at the level of the horizontal slot 24, and is biased towards the back wall 3 through a spring 48. A spiral spring 50 is connected between the lever 35 and the lever 45 to transfer movement between the two levers.

In operation, the tube 20 contains several rolls of paper, each roll being disposed with its longitudinal axis parallel to the longitudinal axis of the tube 20. The lead roll is situated over the spigot 23 to allow the roll to rotate freely while dispensing paper sheets. The next roll is positioned in the tube 20, with downward movement of the roll being prevented by the lever 35. When the lead roll is exhausted, its core is torn away from the spigot 23. Lever 25 is pulled so as to engage lever 35 with arm 28. Lever 45 enters the horizontal slot 24, due to the transmitting action of the spiral spring 50, and bears against the roll situated above the next roll. Simultaneously, lever 35 is rotated away from the bottom opening of the tube 20, allowing the next roll to drop onto the spigot 23. Lever 25 is then released, causing levers 35 and 45 to return to their original positions, and allowing a fresh roll of paper to drop down against the lever 35. Although it appears that the Francis dispenser would not damage the paper rolls upon dispensation, the requirement of the plurality of levers and springs renders the dispenser expensive and difficult to manufacture.

Accordingly, there remains the need for a paper roll dispenser which will not damage the paper rolls upon dispensation, and which is inexpensive and simple to manufacture.

SUMMARY OF THE INVENTION

Accordingly to the present invention, there is a provided an inexpensive paper roll dispenser which retains a column of vertically-oriented cylindrical paper rolls in a container through a stop means which acts upon a substantial part of the surface area of the paper rolls and which allows the lowermost paper roll of the column of paper rolls to be removed from the dispenser without disturbing the remaining paper rolls. As a result, the invention imparts a minimum risk of damage to the paper rolls retained in the dispenser.

The paper roll dispenser, according to the present invention, comprises an upright elongate tubular member having a longitudinal axis and comprising a tubular side wall having an inner tubular surface, an upper inlet port, a lower discharge port, and a tubular passageway coupled to and extending between the inlet port and the discharge port, the tubular passageway, the inlet port and the discharge port each being adapted to allow passage of a paper roll therethrough; an elongate member provided in the tubular passageway; and an actuator coupled to the elongate member for pivoting the elongate member about an axis transverse to the longitudinal axis, between a first position wherein the elongate member obstructs the tubular passageway and a second position wherein the elongate member does not obstruct the tubular passageway.

Although the preferred embodiment of the invention is adapted for storing and dispensing vertically-oriented toilet paper rolls, it is to be understood that the invention can be used to store and dispense paper rolls of any size, shape and physical orientation.

BRIEF DESCRIPTION OF THE DRAWINGS

The preferred embodiment of the invention will now be described with reference to the drawings, in which like reference numerals represent like elements, and in which.

DETAILED DESCRIPTION OF THE PREFERRED EMBODIMENT

Figure 1:
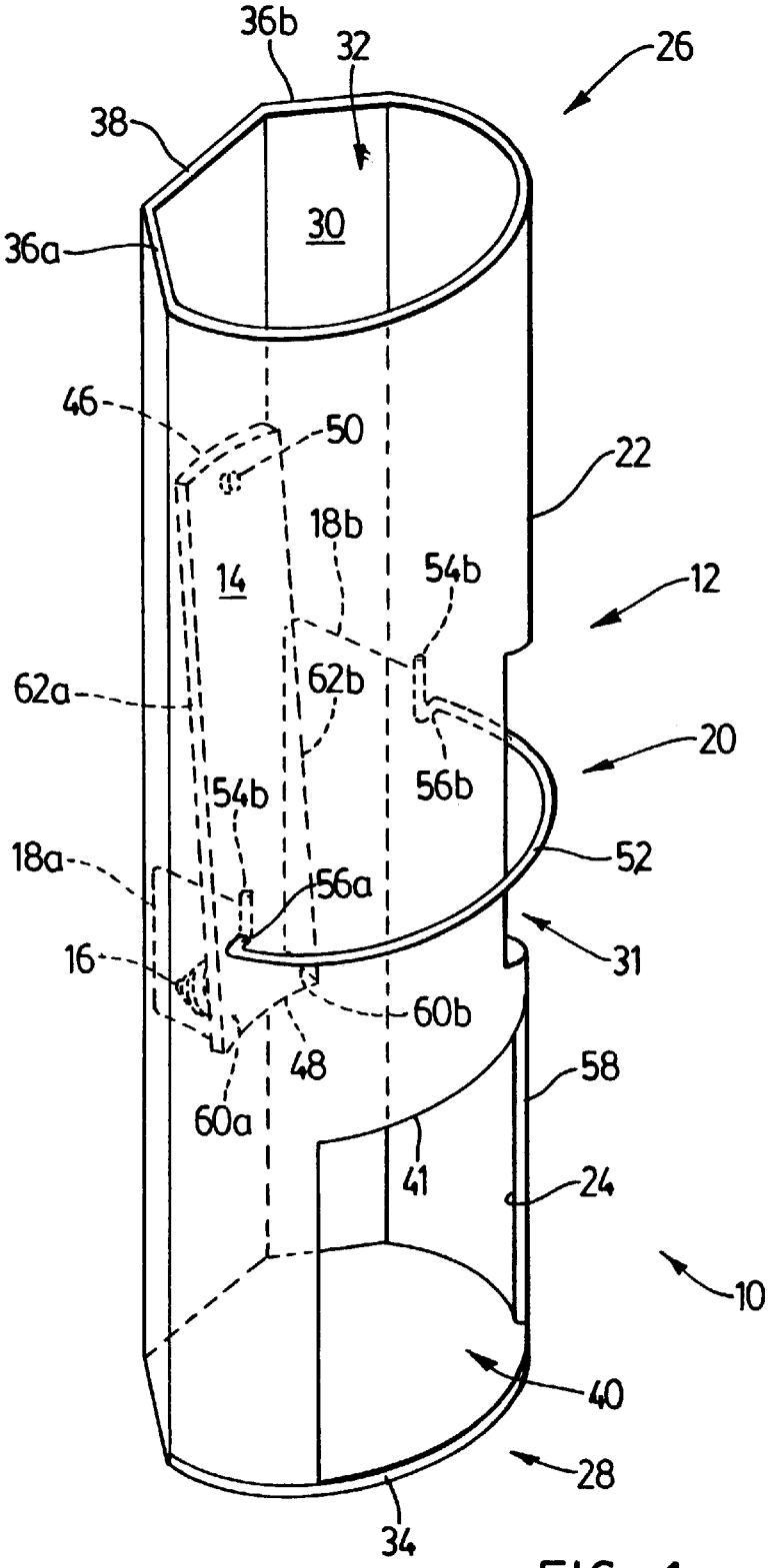
FIG. 1 is a perspective view of the paper roll dispenser according to the present invention.

Referring to FIG. 1, a paper roll dispenser 10 is shown comprising an upright tube 12 for holding a column of vertically-oriented cylindrical paper rolls, a pivoting ramp 14, and an actuator (comprising a coil spring 16, cables 18*a*, 18*b*, and a dispensing lever 20) for pivoting the ramp 14 between a first position which retains the column of paper rolls in the dispenser 10 and a second position which dispenses the lowermost roll from the column of paper rolls. Preferably, the tube 12 is fabricated from transparent plastic material such as cast acrylic. However, the tube 12 may also be fabricated from any other suitable material.

The upright tube 12 includes a tubular side wall 22 having an inner tubular surface 24, a pair of opposite ends 26, 28, and a tubular passageway 30 extending between the opposite ends 26, 28. In one variation, the tube 12 also includes a decorative pattern which adds aesthetic appeal and partially conceals the interior of the tube 12. The decorative pattern is either be glued to a surface of the tube 12, or for added durability, embedded into the tube 12 material itself. A narrow longitudinally-extending opening 31 is formed in the side wall 22 for determining when the dispenser 10 is empty.

Preferably, the upright tube 12 has a substantially cylindrical shape to maximize the contact surface area between the vertically-oriented cylindrical paper rolls and the inner tubular surface 24. This minimizes the risk of damage to the paper rolls by ensuring that the frictional force exerted by the side wall 22 on the rolls to retain the rolls in the tubular passageway 30 is spread over a substantial portion of the surface area of the roll.

The upper end 26 of the upright tube 12 is open and comprises an upper inlet port 32 opening into the tubular passageway 30. The lower end 28 of the tube 12 is coupled to a substantially planar base 34 which assists in maintaining the tube 12 upright. The base 34 extends substantially transverse to the longitudinal axis of the tube 12 and effectively seals the lower end 28 of the tube 12.

To further assist in maintaining the tube 12 upright, the side wall 22 is preferably provided with longitudinally-extending planar joining walls 36*a*, 36*b*, and a longitudinally-extending planar rear wall portion 38 for securing the dispenser 10 to a vertical surface, such as a bathroom wall. In this variation, the front portion of the tube 12 has a U-shaped horizontal cross-section (FIG. 2) and the joining walls 36*a*, 36*b* each extend at an obtuse angle from respective opposite longitudinal side edges of the rear wall 38 to the U-shaped portion of the tube 12. This variation allows the dispenser 10 to be secured to a wall through, for example, cement or fasteners (not shown) passing through the rear wall 38 and engaging the vertical wall.

A discharge port 40 is provided in the side wall 22 adjacent the base 34 and is coupled to the bottom end of the tubular passageway 30. As will be apparent, the tubular passageway 30, the inlet port 32, and the discharge port 40 are adapted to allow passage of a cylindrical paper roll therethrough. However, it is preferable that the upper edge 41 of the discharge port 40 is positioned such that the lower end 48 of the ramp 14 is not readily visible through the discharge port 40.

Figure 2:
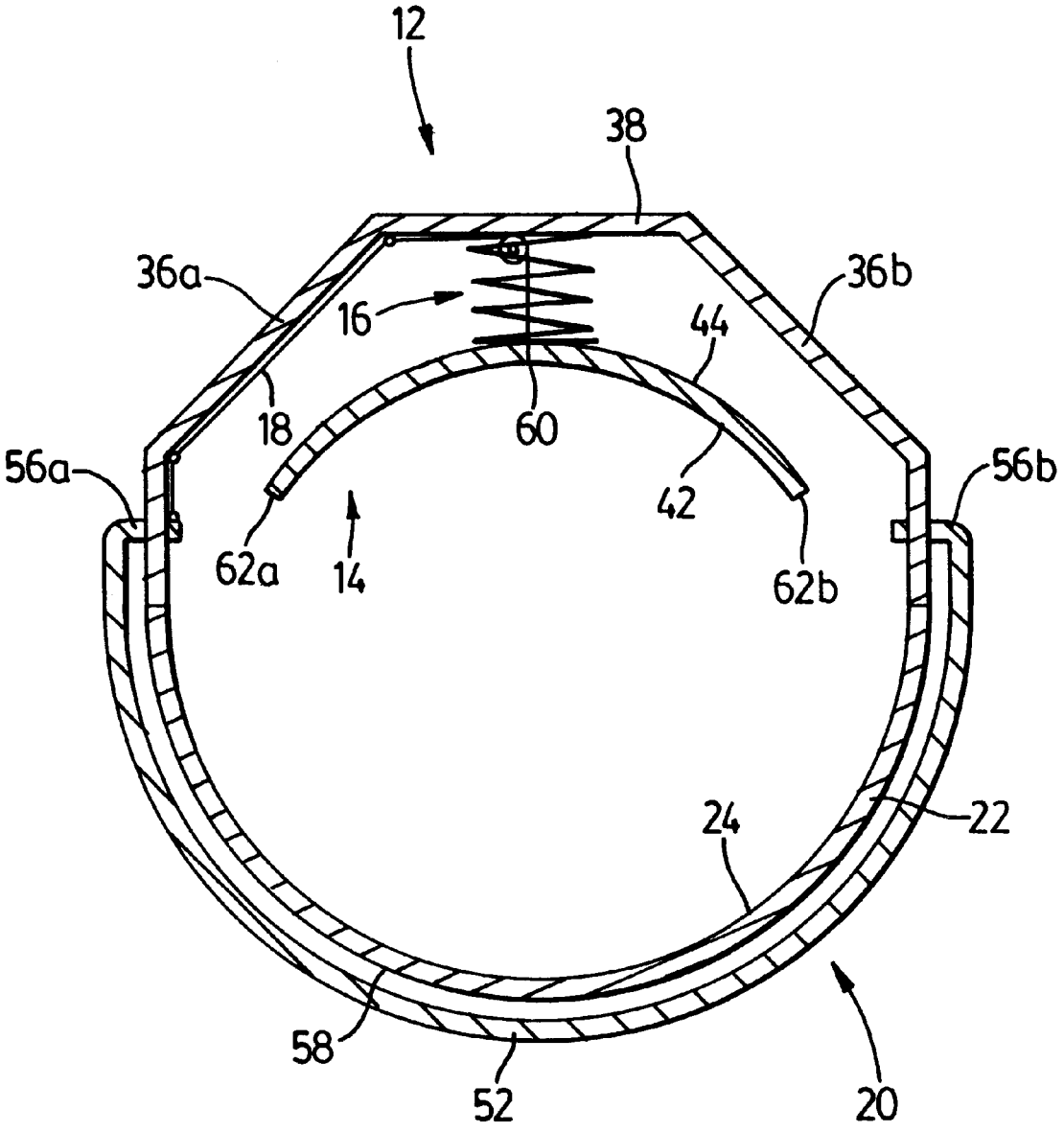
FIG. 2 is a horizontal cross-sectional view of the paper roll dispenser.

The pivoting ramp 14 is positioned upright inside the tubular passageway 30, and comprises an elongate member having a front surface 42 (FIG. 2), a rear surface 44 (FIG. 2), an upper end 46, a lower end 48, and a horizontal cross-section which defines an arc (FIG. 2). Preferably, the ramp 14 is positioned in the tubular passageway 30 such that the lower end 48 is located a distance above the base 34 which is less than the height of two vertically-stacked paper rolls but greater than the height of a single roll.

Adjacent the inlet port 32, a bolt 50 is provided for coupling the ramp 14 to the inner tubular surface 24 of the tubular member 12. The bolt 50 extends through the side wall 22 and the upper end 46, and acts as pivot means to allow the ramp 14 to pivot about an axis transverse to the longitudinal axis of the tube 12.

Preferably, the ramp 14 is sufficiently wide and the eccentricity of the arc conforms sufficiently to the shape of the paper rolls in order to maximize the contact surface area between the paper rolls and the front surface 42. This variation minimizes the risk of damage to the paper rolls by ensuring that the frictional force exerted by the inner tubular surface 24 and the front surface 42 on the column of rolls to retain the rolls in the tubular passageway 30 is spread over a substantial portion of the surface area of the roll.

The coil spring 16 of the actuator is coupled to the lower end 48 of the ramp 14 between the planar rear wall 38 of the tube 12, at one end, and the rear surface 44 (FIG. 2) of the ramp 14, at the other end. As will be appreciated, the coil spring 16 serves to deflect the lower end 48 of the ramp 14 away from the rear wall 38.

The dispensing lever 20 of the actuator is fabricated from metal or any other suitable material and includes a planar U-shaped portion 52 which substantially conforms in shape to the shape of the U-shaped front portion of the tube 12. The lever 20 also includes a pair of levers 54*a*, 54*b* which are oriented transverse to the plane of the U-shaped portion 52 and are coupled to the respective ends of the U-shaped portion 52 through inwardly radiating arms 56*a*, 56*b*. The arms 56*a*, 56*b* each extend through a respective pivot port (not shown) formed in the side wall 22, on opposite sides of the tube 12, so that the levers 54*a*, 54*b* are positioned upright in the tubular passageway 30 and the U-shaped portion 52 is positioned adjacent the outer surface 58 of the tube 12 with the plane of the U-shaped portion 52 being transverse to the longitudinal axis of the tube 12. The pivot ports are displaced a common distance from the lower end 28 to allow the U-shaped portion 52 and the levers 54*a*, 54*b* to pivot about a respective axis transverse to the longitudinal axis of the tube 12.

The cables 18*a*, 18*b* of the actuator comprises nylon line, or any other suitable material. The cables 18*a*, 18*b* extend between a respective lever 54*a*, 54*b*, through eyes or pulleys (not shown) secured to the inner tubular surface 24, to a respective termination point 60*a*, 60*b* provided on the ramp 14 positioned adjacent a respective longitudinal side edge 62*a*, 62*b* of the ramp 14. This configuration ensures that the ramp 14 is not subject to forces which tend to twist the ramp 14 about its longitudinal axis when the ramp is pivoted. In one variation, shown in FIG. 2, the cables 18*a*, 18*b* are replaced with a single cable 18 which extends from only one lever 52 to a termination point 60 on the ramp 14 positioned centrally between the opposite longitudinal side edges 62*a*, 62*b*.

In another variation, not shown, the spring 16 and the cables 18*a*, 18*b* are replaced with a spring-loaded eccentric cam which biases the lower end 48 of the ramp 14 away from the rear wall 38. The cam is positioned between the planar rear wall 38 of the tube 12 and the rear surface 44 of the ramp 14 and engages the rear surface 44. The lever 20 is coupled to the cam to pivot the cam about an axis transverse to the longitudinal axis of the tube 12. As will be appreciated, upward or downward deflection of the U-shaped portion 52 is translated into lateral movement of the lower end 48 of the ramp 14 through the cam.

In operation, paper rolls are inserted into the tubular passageway 30 through the inlet port 32, with the longitudinal axis of each roll being parallel to the longitudinal axis of the tube 12. At rest, the spring 16 deflects the lower end 48 of the ramp 14 away from the rear wall 38, and exerts a tension on the cables 18*a*, 18*b* so as to maintain the U-shaped portion 52 of the dispensing lever 20 in the position shown in FIG. 1. In this position, the lower end 48 of the ramp 14 partially obstructs the tubular passageway 30 so that the lowermost paper roll of the plurality of paper rolls contained in the tube 12 is pressed between the inner surface 42 of the ramp 14 and the inner tubular surface 24 of the tube 12. Accordingly, in the position shown in FIG. 1, the lowermost roll cannot pass the lower end 48 to enter the discharge port 40.

When a paper roll is required, the U-shaped portion 52 of the dispensing lever 20 is pressed downwards by hand so as to rotate the levers 54*a*, 54*b* away from the rear wall 38. As a result, tension in the cables 18*a*, 18*b* increases and the lower end 48 of the ramp 14 is pulled rearwardly until the ramp 14 is substantially parallel to the rear wall 38. In this position, the lower end 48 no longer obstructs the tubular passageway 30 so that the lowermost paper roll of the plurality of paper rolls contained in the tube 12 drops downwards past the lower end 48, onto the base 34 and into the discharge port 40. Simultaneously, the next lowermost paper roll falls downwards into the position formerly occupied by the lowermost roll.

The dispensing lever 20 is then released, and the lower end 48 of the ramp 14 returns to the position shown in FIG. 1. The lower end 48 once again partially obstructs the tubular passageway 30, so that the next lowermost paper roll is pressed between the inner surface 42 of the ramp 14 and the inner tubular surface 24 of the tube 12. The lowermost paper roll can then be removed from the tube 12 through the discharge port 40 without disturbing the remaining rolls in the tube 12.

It is to be understood that the description of the preferred embodiment is not intended to be exhaustive of the present invention. Those of ordinary skill will be able to make certain additions, deletions and/or modifications to the disclosed embodiment without departing from the spirit or scope of the invention, as defined by the appended claims.

I claim:

1. A paper roll dispenser comprising:

an upright elongate tubular member having a longitudinal axis and comprising a tubular side wall having an inner tubular surface, an upper inlet port, a lower discharge port, and a tubular passageway coupled to and extending between the inlet port and the discharge port, the tubular passageway, the inlet port and the discharge port each being adapted to allow passage of a paper roll therethrough;

said tubular member having a rear portion comprising a planar central wall portion and two side wall portions extending symmetrically on each side of said central wall portion and each at an obtuse angle to the central wall portion and wherein said side wall portions extend at substantially a right angle to one another;

a plate form elongate member provided in the tubular passageway, said plate form elongate member having a horizontal cross-section that defines an arc with a concave side facing forwardly, and an upper end of said plate form elongate member being pivotally coupled to said rear portion of said tubular member at a point spaced downwardly from said upper inlet port by a coupling member passing through said upper end and through said rear portion; and an actuator coupled to the elongate member for pivoting the elongate member about an axis transverse to the longitudinal axis, between a first position wherein the elongate member obstructs the tubular passageway and a second position wherein the elongate member does not obstruct the tubular passageway.

2. A dispenser according to claim 1, wherein a front portion of the tubular member has a substantially cylindrical shape.

3. A dispenser according to claim 1, wherein the actuator is coupled to the elongate member adjacent a lower end thereof.

4. A dispenser according to claim 1, wherein the tubular member includes a pair of opposite ends, one of the opposite ends comprising the inlet port, the other end being coupled to a substantially planar base member extending transversely to the longitudinal axis.

5. A dispenser according to claim 4, wherein the dispensing port is provided in the side wall adjacent the base.

6. A dispenser according to claim 1, wherein the side wall comprises substantially transparent plastic material.

7. A dispenser according to claim 6, wherein the plastic material is acrylic.

8. A dispenser according to claim 1, wherein the side wall includes a decorative pattern.

9. A paper roll dispenser comprising:

an upright elongate tubular member having a longitudinal axis and comprising a tubular side wall having an inner tubular surface, an upper inlet port, a lower discharge port, and a tubular passageway coupled to and extending between the inlet port and the discharge port, the tubular passageway, the inlet port and the discharge port each being adapted to allow passage of a paper roll therethrough;

an elongate member provided in the tubular passageway; and an actuator coupled to the elongate member for pivoting the elongate member about an axis transverse to the longitudinal axis, between a first position wherein the elongate member obstructs the tubular passageway and a second position wherein the elongate member does not obstruct the tubular passageway;

wherein the elongate member is coupled to the tubular member with pivot means provided adjacent the inlet port; and wherein the actuator comprises a spring coupled between the tubular member and the elongate member, a dispensing lever pivotally coupled to the tubular member, and a cable coupled between the elongate member and the dispensing lever.

* * * * *